US006619742B1

(12) United States Patent
Bellefleur

(10) Patent No.: US 6,619,742 B1
(45) Date of Patent: Sep. 16, 2003

(54) PIVOT ASSEMBLY FOR SWIVELING CHAIR

(75) Inventor: Pierre Bellefleur, Magog (CA)

(73) Assignee: Dutailier International Inc., St-Pie de Bagot (CA)

( * ) Notice: Subject to any disclaimer, the term of this patent is extended or adjusted under 35 U.S.C. 154(b) by 0 days.

(21) Appl. No.: 09/461,968

(22) Filed: Dec. 15, 1999

(51) Int. Cl.[7] ..... A47C 3/18

(52) U.S. Cl. ..... 297/344.21; 297/344.26; 403/119

(58) Field of Search ..... 297/344.21, 344.22, 297/344.26; 403/110, 119, 120, 109.5; 248/131

(56) References Cited

U.S. PATENT DOCUMENTS 3,539,234 A * 11/1970 Rapata ..... 403/109.5 X
3,593,954 A * 7/1971 Ritchie ..... 297/344.21
4,928,620 A * 5/1990 Currey ..... 297/344.21 X
4,977,848 A * 12/1990 Currey ..... 287/344.21 X

* cited by examiner

*Primary Examiner*—Anthony D. Barfield
(74) *Attorney, Agent, or Firm*—Ladas & Parry

(57) ABSTRACT

A pivot assembly for a swiveling chair is provided. The pivot assembly includes an elongated rod received in a tubular element, the elongated rod being capable to pivot by the intermediary of bearing assemblies such as to allow the chair to swivel. Each bearing assembly includes two segments mechanically engaged with one another. Each bearing assembly is responsive to pressure tending to urge the segments toward one another such as to close itself on the elongated rod and thus reduce or eliminate any clearance that may develop between the elongated rod and the bearing assembly. This arrangement is useful because it eliminates or at least it reduces free play that may develop in the components of the pivot assembly over time.

19 Claims, 16 Drawing Sheets

PIVOT ASSEMBLY FOR SWIVELING CHAIR

FIELD OF THE INVENTION

The present invention relates to of the art of manufacturing chairs and, more particularly, to a novel pivot assembly for swiveling chairs. The pivot assembly is characterized by its ability to maintain tight tolerances between its component parts during its useful life to prevent undesirable free play felt by the occupant of the chair when the latter shifts the position of his body while being seated.

BACKGROUND OF THE INVENTION

A typical swiveling chair includes a body supporting structure that is mounted on a chair base by a pivot assembly. Many different pivot assembly arrangements have been developed in the past to suit a wide variety of applications. One type of pivot assembly that is fairly common comprises an elongated rod that extends generally upright, depending from the body supporting structure. The elongated rod is received in a tubular element that is secured to the chair base. Bearings between the elongated rod and the tubular element allow the swiveling motions to take place. Normally, two separate bearing assemblies are used to connect the elongated rod to the tubular element. The two bearing assemblies are mounted in spaced apart relationship on the elongated rod.

It is well known that overtime the clearances between the various components of the pivot assembly will progressively increase. This occurs as a result of normal wear. This increase in clearances will result in an undesirable free play in the pivot assembly that can be distinctly felt by the user, particularly as a result of body shifts. For example, when the body of the user leans forward or leans backwards the center of gravity crosses the imaginary vertical plane containing the swiveling axis and makes this free play particularly noticeable.

To overcome, this problem, it is known to provide the pivot assembly with an adjustable cushion designed to reduce the undesirable free play. This adjustable cushion is in the form of a polymeric sleeve that is placed within the tubular element and surrounds the elongated rod. Adjustment screws are placed on the tubular element to urge the polymeric sleeve towards the elongated rod such as to eliminate the free play. The difficulty of this approach is the requirement from the user to make periodic adjustments. Also, once an adjustment has been made the polymeric sleeve will be able to eliminate or reduce the free play usually over a fairly short period of time, such as a couple of weeks. After this period of time has elapsed, the free play will progressively reappear and the user will be required to perform the adjustment again.

Against this background, it clearly appears that there is a need in the industry to provide a pivot assembly that has the ability to maintain tight tolerances between its component parts over long time periods and that does not require frequent periodic adjustments.

SUMMARY OF THE INVENTION

In one aspect the present invention provides a pivot assembly for a swiveling chair, the pivot assembly being suitable for supporting a body supporting structure of the chair on a chair base and allow the body supporting structure to swivel with relation to the chair base. The pivot assembly comprises a first pivot assembly component for connection to the body supporting structure and a second pivot assembly component for connection to the chair base. One of the first and second pivot assembly components including an elongated rod oriented generally upright.

A bearing assembly is mounted between the first and the second pivot assembly components to allow the pivot assembly components to swivel one with relation to the other. The bearing assembly defines an aperture that receives the elongated rod. The bearing assembly is responsive to pressure applied downwardly on the pivot assembly to tend to close the aperture on the elongated rod.

The downward pressure applied on the bearing assembly can originate from different sources. In one possible nonlimiting example of implementation, the downward pressure is a combination of two factors, the first factor being the weight of the body of the occupant when seated in the body supporting structure, while the second factor is a resilient element that urges the pivot assembly downwards. It should be appreciated that in this specific nonlimiting example of implementation, the resilient element is optional and it can be omitted without departing from the spirit of the invention. Under a possible variant where no resilient element is present, the pivot assembly relies solely on the weight of the body of the occupant to generate the downward pressure necessary to tend to close the aperture in the bearing assembly around the elongated rod. Yet, another possibility is to provide a large resilient element that alone, without relying on the body weight of the occupant, could generate the downward pressure sufficient to tend to close the aperture of the bearing assembly on the elongated rod in a manner to reduce or eliminate clearances.

Having regards to the above, it should be appreciated that the expression "downwards pressure" in this specification is not limited to any particular external influence or a combination of external influences that generate the downward pressure acting on the pivot assembly. The expression "downward pressure" is intended to encompass all possible sources or combination of such sources of downward force acting on the pivot assembly as long as the resulting magnitude is sufficient to tend to close the aperture of the bearing assembly on the elongated rod.

The advantage of this pivot assembly in accordance with this invention is its ability to maintain tight tolerances primary between the elongated rod and the bearing assembly. As a result, less frequent adjustments are necessary to compensate for free play by comparison to prior art devices.

In a specific nonlimiting example of implementation, the first pivot assembly component is the elongated rod while the second pivot assembly component is a tubular element that receives the elongated rod. The bearing assembly includes a first segment and a second segment concentrically mounted on the elongated rod. The first segment of the bearing assembly includes a downward tapering recess formed on the second segment. The first segment includes a slot that extends along the elongated rod. Functionally, under this nonlimiting example of implementation, the first segment behaves as a slotted ring and it can be progressively tightened on the elongated rod in response to radial force applied on the first segment. This radial force is generated as a result of the tapering configuration of the mating surfaces of the first and of the second segments, when downward pressure is applied on the pivot assembly. implementation, the pivot assembly includes a second bearing assembly that is mounted on the elongated rod and it is in a spaced apart relationship with relation to the first bearing assembly. The second bearing assembly functions in a similar manner as the first bearing assembly with one notable exception. This exception is that the mating surfaces between the first and the second segments of the second bearing assembly are oriented in such a way that they taper upwardly, in other words opposite the direction of taper of the mating surfaces of the first and the second segments of the first bearing assembly.

Under a different aspect, the present invention provides a pivot assembly for a swiveling chair, the pivot assembly being suitable for supporting a body supporting structure of the chair on a chair base and allowing the body supporting structure to swivel with relation to the chair base. The pivot assembly comprises a first pivot assembly component for connection to the body supporting structure and a second pivot assembly component for connection to the chair base. One of the first and second pivot assembly components includes an elongated rod oriented generally upright. A bearing assembly is mounted between the first and second pivot assembly components to allow the pivot assembly components to swivel one with relation to the other. The bearing assembly defines an aperture that receives the elongated rod. The bearing assembly includes a first segment and a second segment that are mechanically engaged and operative to pivot one with relation to another when the pivot assembly swivels. The bearing assembly is responsive to pressure urging the segments toward one another to tend to close the aperture on the elongated rod.

The pressure urging the segments of the bearing assembly toward one another can come from one or more sources, such as the body weight of the occupant of the chair and/or a resilient element in the pivot assembly operative to urge the segments toward one another.

The present invention also extends to a swiveling chair including the pivot assembly described above.

In a different aspect the invention provides a pivot assembly for a swiveling chair, the pivot assembly being suitable for supporting the body supporting structure of the chair on a chair base and allowing the body supporting structure to swivel with relation to the chair base. The pivot assembly comprises a first pivot assembly component for connection to the body supporting structure and a second pivot assembly component for connection to the chair base, one of the first and second pivot assembly components including an elongated rod oriented generally upright. A bearing assembly is mounted between the first and the second pivot assembly components. The bearing assembly allows the pivot assembly components to swivel one relative to the other. The bearing assembly includes a first segment and a second segments, the first segment including a tapered projection and being concentrically mounted on the elongated rod. The first segment is secured on the elongated rod against movement on the elongated rod along a direction parallel to the elongated rod and a direction transverse to the elongated rod. The second segment includes a tapered recess receiving the tapered projection. The first and second segments are in mechanical engagement and operative to pivot one with relation to the other when the pivot assembly swivels.

BRIEF DESCRIPTION OF THE DRAWINGS

In FIG. 1, only the structure of the chair is shown, the upholstery being removed for purposes of clarity;

DETAILED DESCRIPTION

Figure 1:
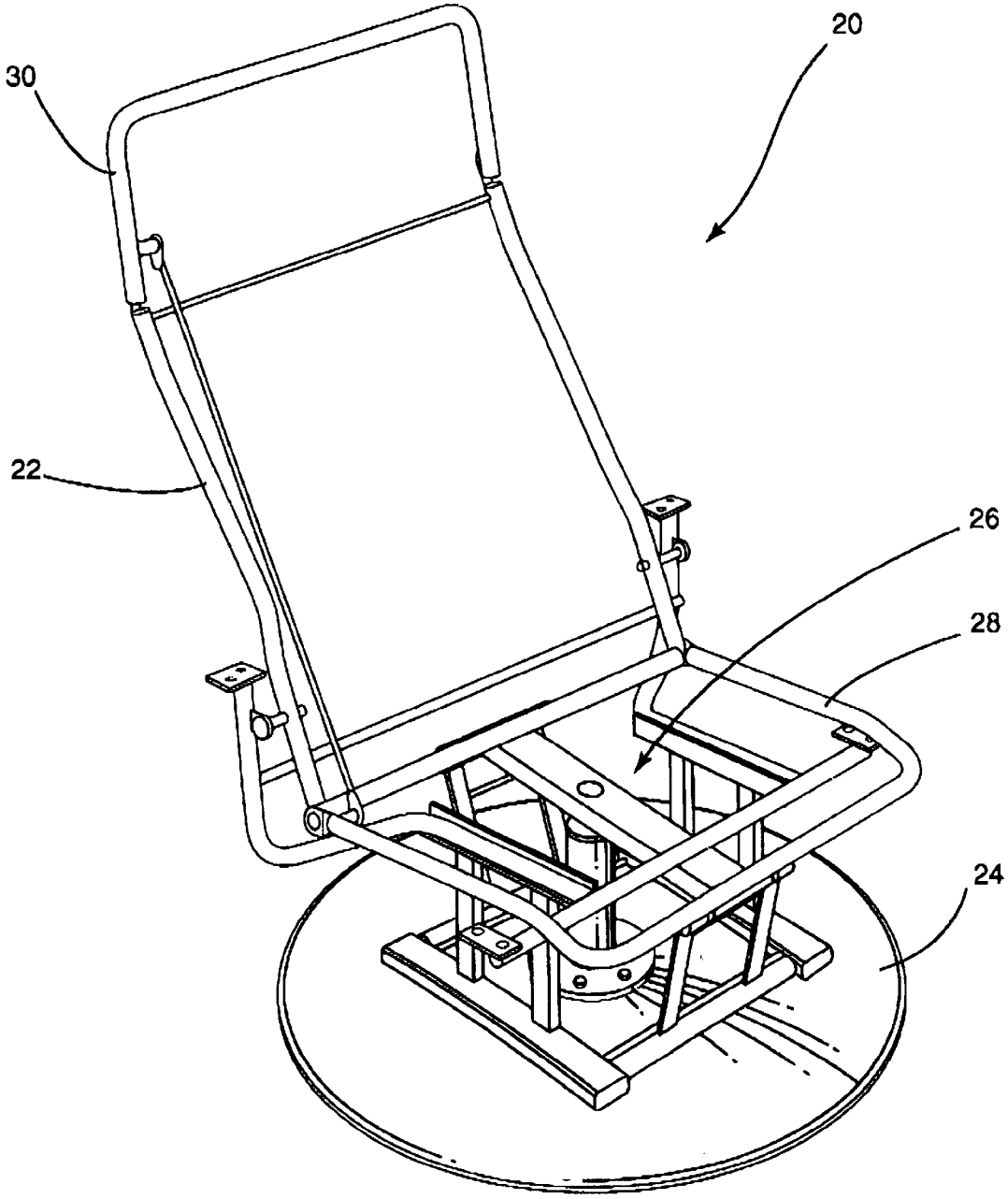
FIG. 1 is a perspective view of a rocking and a swiveling chair incorporating the pivot assembly constructed according to the principles of the present invention.

FIG. 1 of the drawings illustrates a chair designated by the reference numeral 20 that embodies the principles of the present invention. The chair 20 can be broken down into three main components namely a body supporting structure 22, a chair base 24 and a pivot assembly 26 that connects the body supporting structure 22 to the chair base 24.

The body supporting structure 22 comprises two main components namely a seat portion 28 and a backrest 30. The chair base 24 comprises a circular member of sufficient size to adequately support the chair 20 on the floor, although this is only a question of design since a wide variety of chair bases can be used here without departing from the spirit of the invention.

Figure 2:
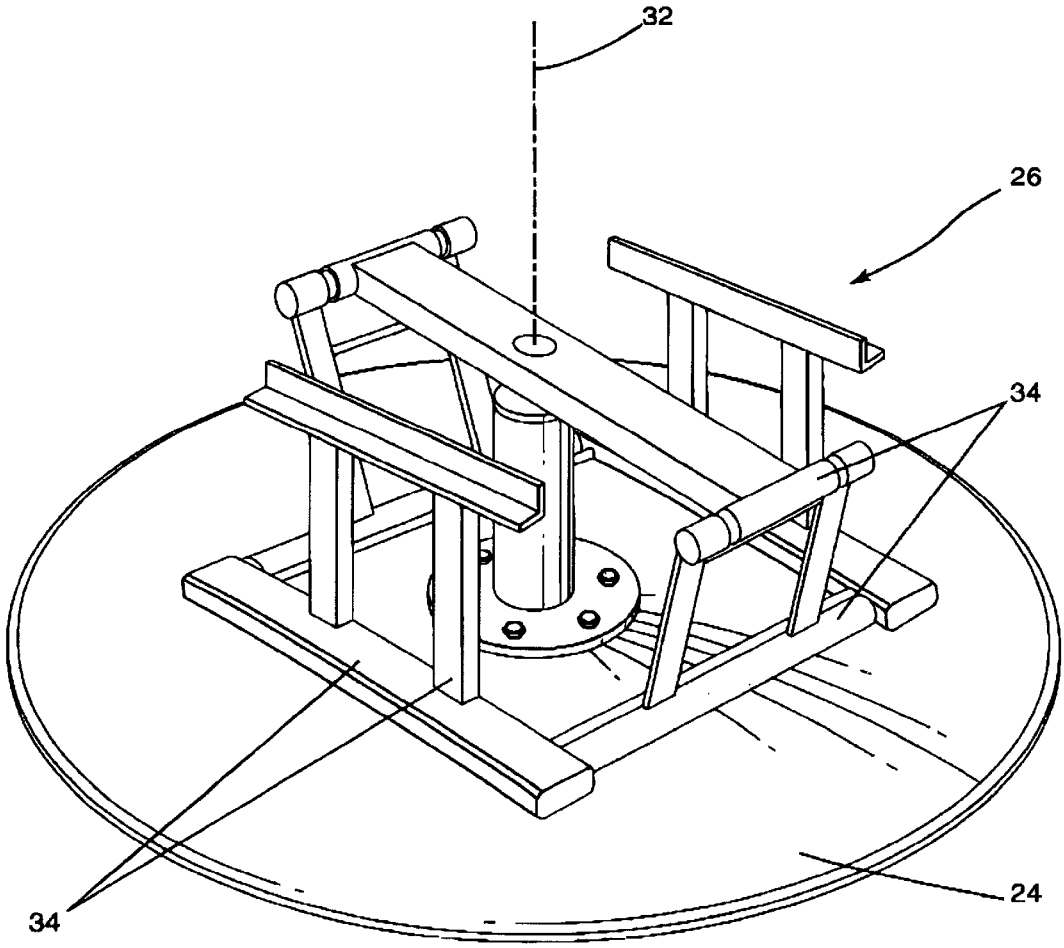
FIG. 2 is a perspective view of the mechanism allowing the chair of FIG. 1 to rock and to swivel.

The pivot assembly 26 is depicted in greater detail in FIG. 2. In the example of implementation of the invention illustrated in the drawings, the pivot assembly 26 allows the body supporting structure 22 to swivel about a generally vertical axis 32. The pivot assembly 26 is also combined to a rocking mechanism 34 that allows the body supporting structure 22 to rock back and forth. It should be noted that the rocking capability of the chair is merely optional and the pivot assembly 26 according to the invention can be used in chairs that do not rock.

Figure 3:
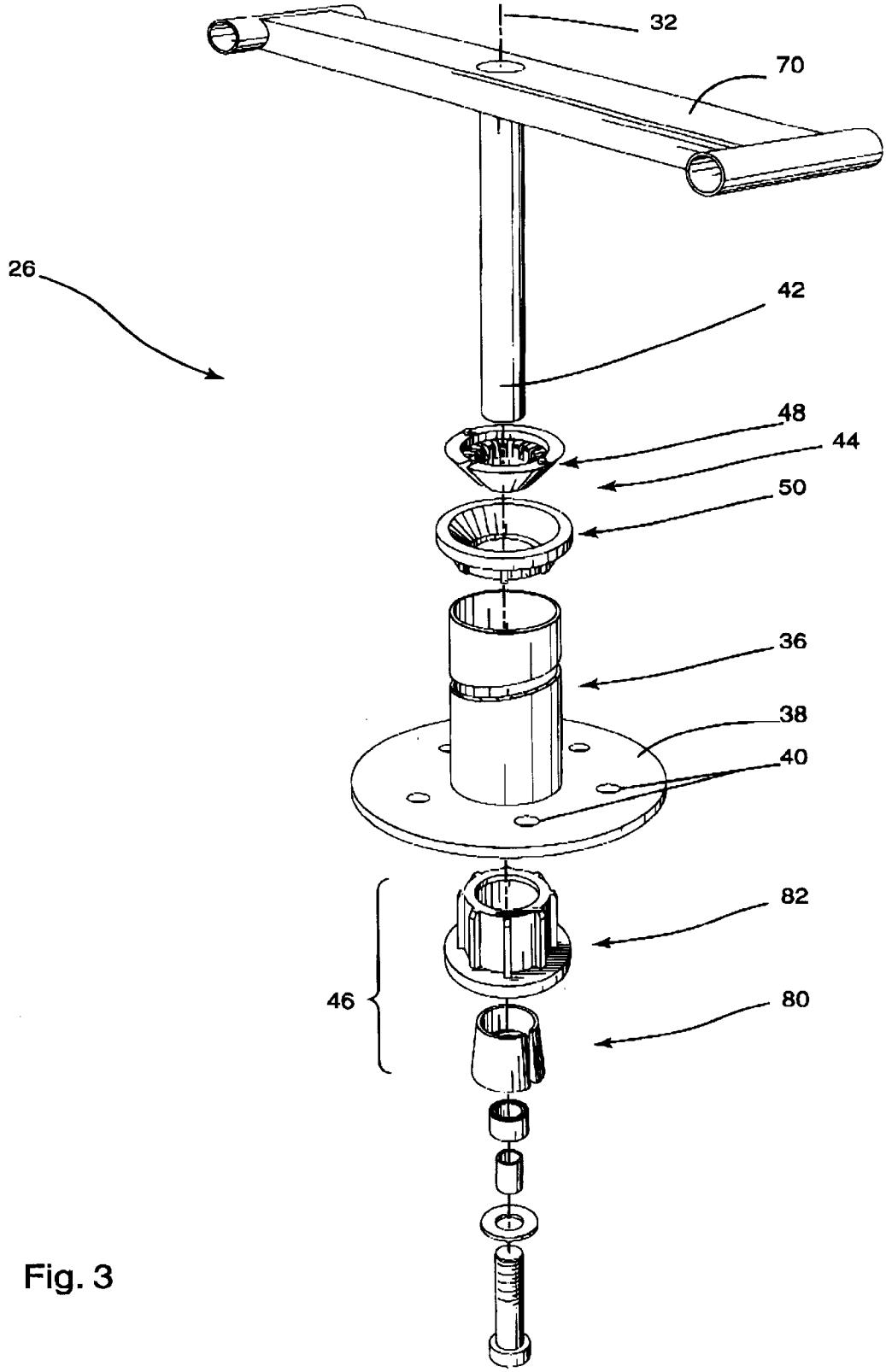
FIG. 3 is a perspective exploded view of the pivot assembly of the chair shown in FIG. 1.
Figure 4:
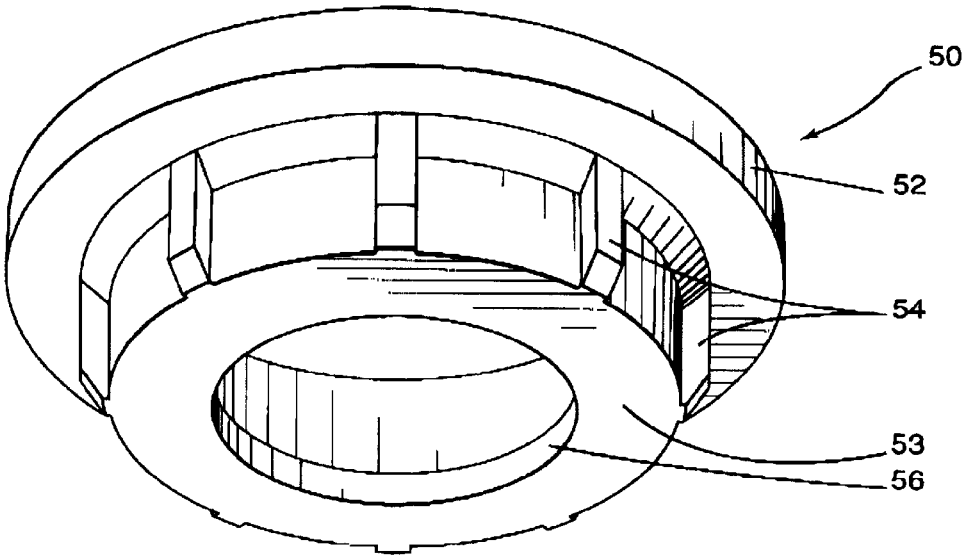
FIG. 4 is a perspective view of the second segment of the first bearing assembly of the pivot assembly in accordance with the invention.
Figure 5:
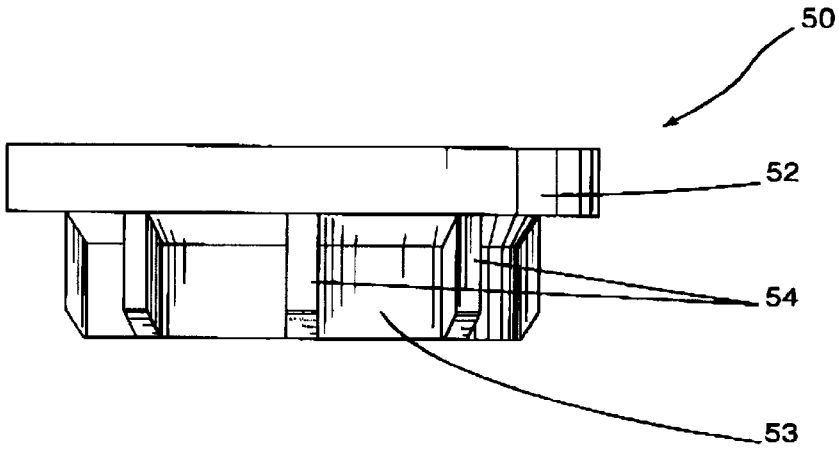
FIG. 5 is d side elevational view of the second segment shown in FIG. 4.
Figure 6:
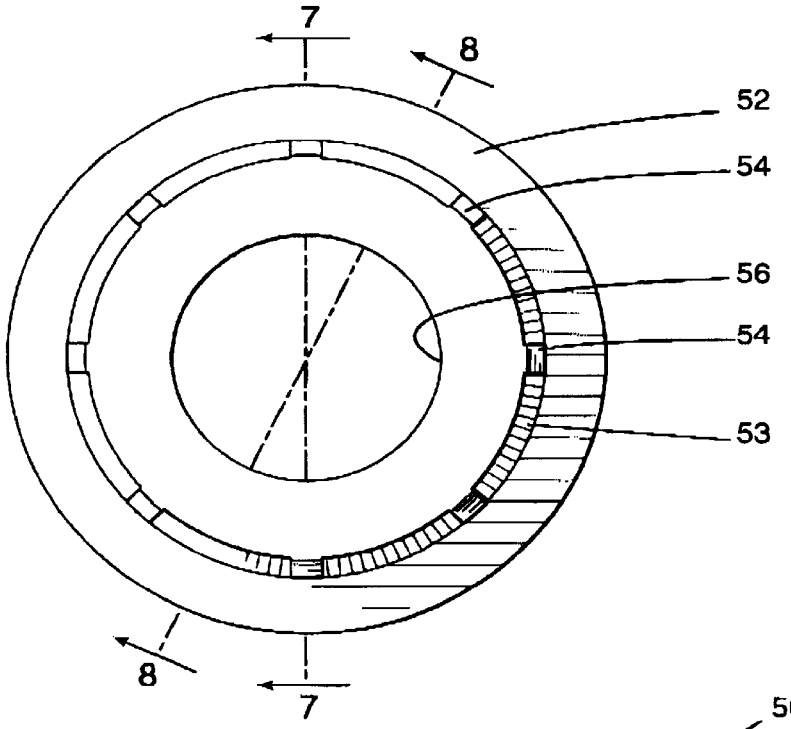
FIG. 6 is a bottom plan view of the second segment shown in FIG. 4.

FIG. 3 provides an exploded view of the pivot assembly 26. The pivot assembly 26 comprises a tubular element 36 that includes near the lower extremity a flange 38 provided with apertures 40 to receive fasteners allowing to retain the tubular element 36 to the chair base 24. This is one from of realization only as many other ways to mount the tubular element 36 to the chair base 24 can be used without departing from the spirit of the invention. The tubular element 36 receives an elongated rod 42 that can pivot about the swiveling axis 32 through the intermediary of two bearing assemblies, namely a first bearing assembly 44 and a second bearing assembly 46. The bearing assemblies 44, 46 are mounted on the elongated rod 42 in a spaced apart relationship such as to support portions of the elongated rod 42 that register with the upper end and with the lower end of the tubular element 36, respectively.

Figure 7:
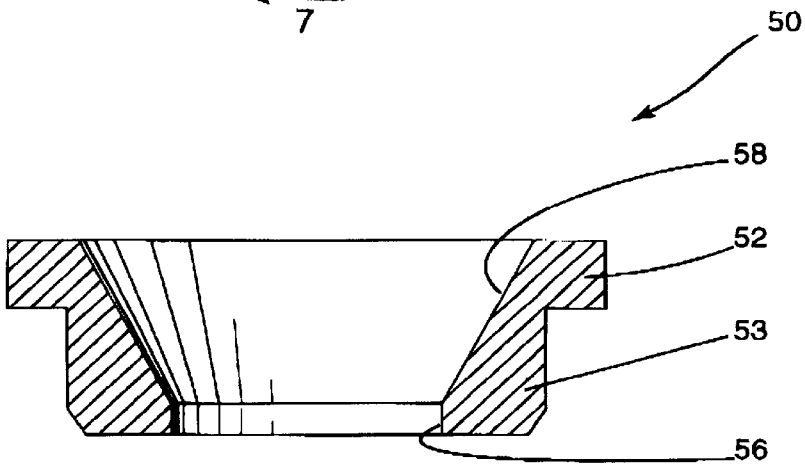
FIG. 7 is a cross sectional view taken along lines 7—7 in FIG. 6.
Figure 8:
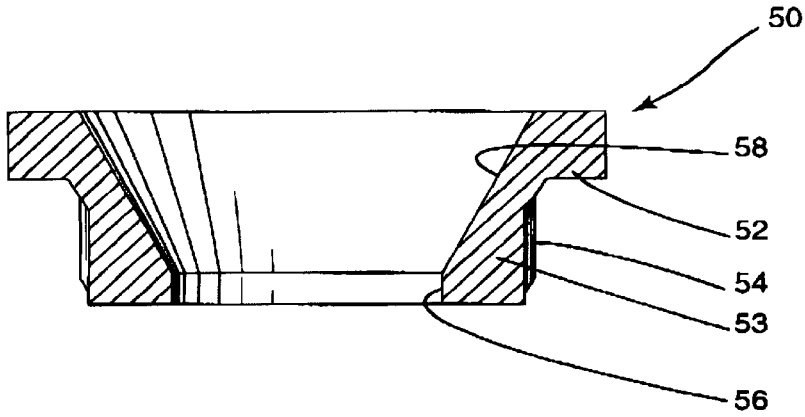
FIG. 8 is a cross sectional view taken along lines 8—8 in FIG. 6.
Figure 9:
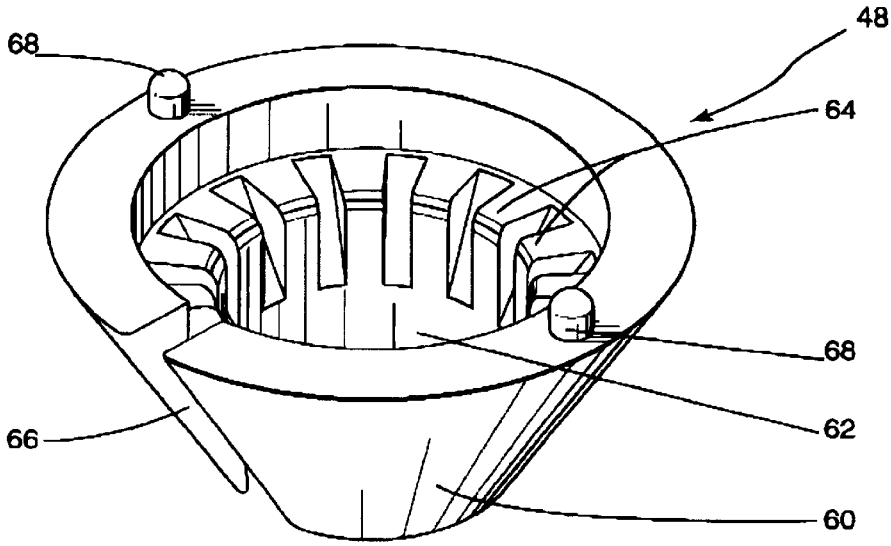
FIG. 9 is a perspective view of the first segment of the first bearing assembly of the pivot assembly in accordance with the invention.
Figure 10:
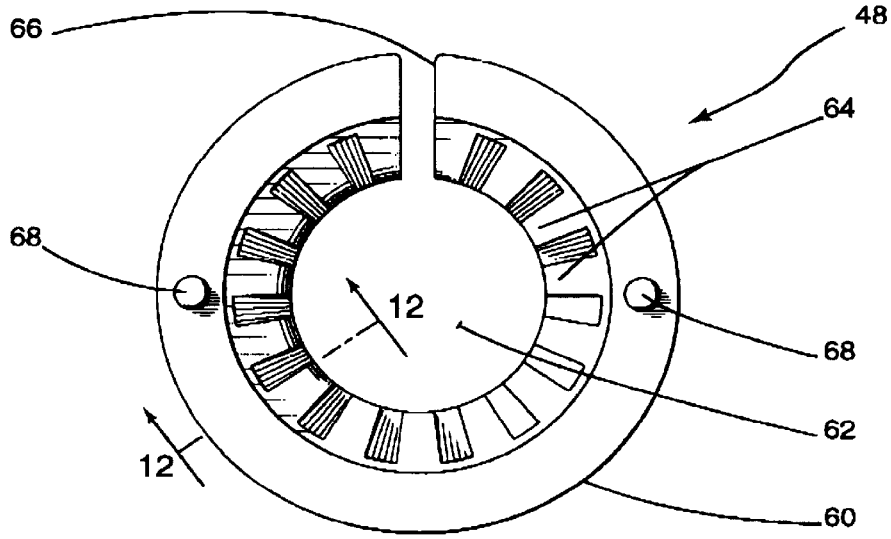
FIG. 10 is a top plan view of the first segment depicted in FIG. 9.
Figure 11:
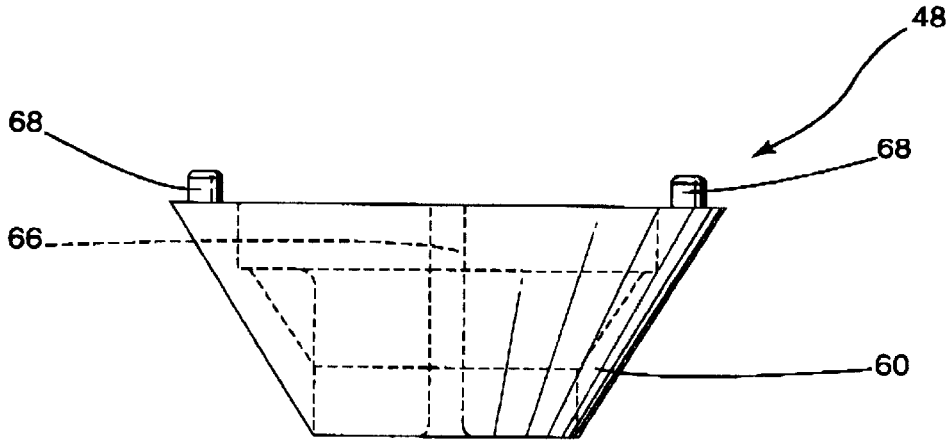
FIG. 11 is a side elevational view of the first segment depicted in FIG. 9.
Figure 12:
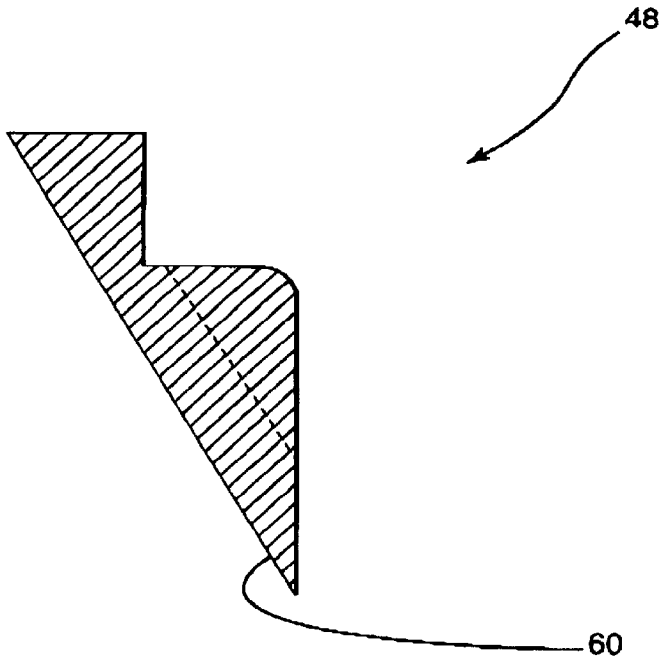
FIG. 12 is a cross sectional view taken along lines 12—12 in FIG. 10.
Figure 13:
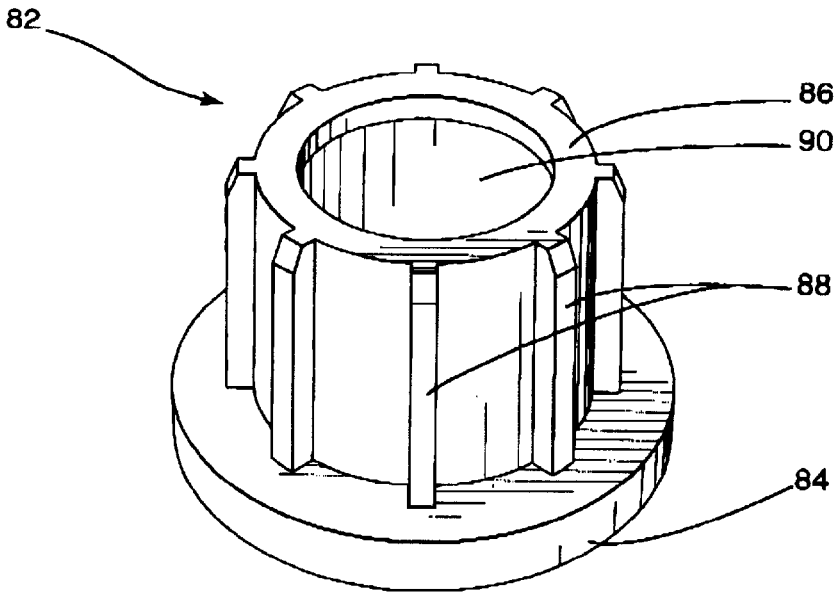
FIG. 13 is a perspective view of the second segment of the second bearing assembly of the pivot assembly in accordance with the invention.
Figure 14:
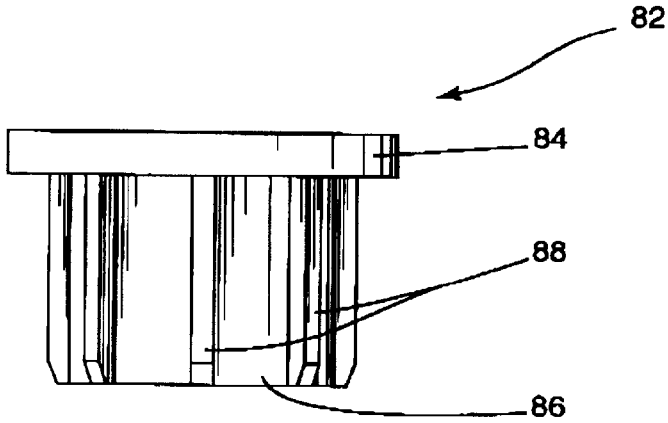
FIG. 14 is a side elevational view of the second segment depicted in FIG. 13.
Figure 15:
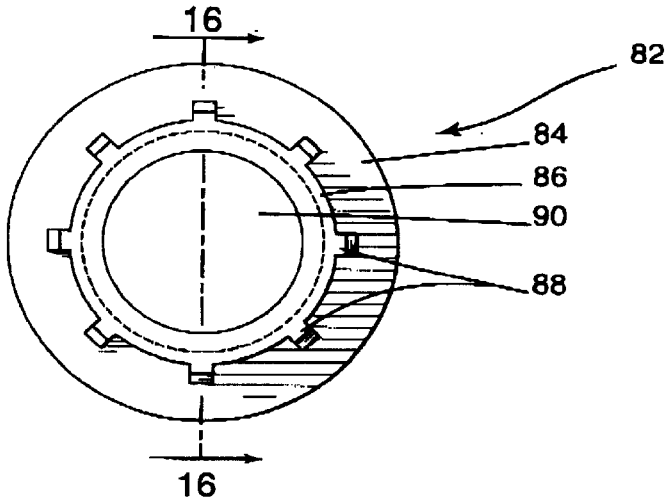
FIG. 15 is a bottom plan view of the second segment depicted in FIG. 13.

The first bearing assembly 44 includes two components namely a first segment 48 and a second segment 50. The structure of the second segment 50 is depicted in FIGS. 4, 5, 6, 7 and 8. The second segment 50 includes an annular body with a radially projecting flange 52 from which depends a cylindrical element 53. The cylindrical element 53 carries a plurality of regularly spaced and radially projecting ribs 54. The second segment 50 defines a centrally located circular bore 56 designed to accommodate the elongated rod 42. Referring now to FIGS. 7 and 8 that show cross-sectional views of the second segment 50, it will be apparent that the second segment 50 defines immediately above the circular bore 56 a tapering recess 58. The recess 58 tapers downwardly.

The second segment 50 is made from plastic material and it is designed to be forcibly inserted into the upper extremity of the tubular member 36. Accordingly, the diameter of the array of ribs 54 should slightly exceed the internal diameter of the tubular member 36. During the installation, the second segment 50 is applied with pressure against the tubular element 36 to cause the ribs 54 to compress or distort and frictionally engage the inner wall of the tubular element 36.

The second segment 50 is designed to receive the first segment 48 that is illustrated in greater detail in FIGS. 9, 10, 11 and 12. The first segment 48 comprises an annular tapering body in the form of a truncated cone. In particular, the first segment 48 comprises an outer tapering wall 60 whose geometrical configuration matches the configuration of the recess 58 in the second segment 50. Accordingly, the first segment 48 is capable to matingly engage the second segment 50 and rotate therein. The first segment 48 includes a central bore 62 defined by an array of radially inwardly projecting fingers 64. In a possible variant, the internal wall defining the bore 62 may be smooth and continuous, rather than including fingers 64.

The first segment 48 includes a slot 66 that extends completely from one extremity of the first segment 48 to the other extremity thereof and also extends transversely from the outer tapering wall 60 to the internal aperture 62. The slot 66 is oriented in such manner that it extends along the elongated rod 42. The dimensions of the first segment 48 are such the diameter of the bore 62 is slightly less than the diameter of the rod 42. To fit the first segment 48 on the rod 42 it suffices to open up the first segment 48 (this movement is allowed by the slot 66) against the resiliency of the first segment 48 such as to slip the first segment 48 on the elongated rod 42.

In use, the first segment 48 is received in the second segment 50. The respective bores 56, 62 acquire a condition of alignment and jointly define an aperture of the bearing assembly 44 that can receive the elongated rod 42. The first segment 48 behaves as a slotted ring that, in response to radial pressure applied against the wall 60 tends to close, by virtue of the slot 66, the aperture of the bearing assembly 44. This causes the clearance between the ribs 64 and the elongated rod 42 to diminish and to be entirely eliminated when the ribs 64 engage the surface of the elongated rod 42.

The first segment 48 also comprises a pair of projections 68 that originate from the base of the inverted truncated conical structure. The projections 68 are received in a horizontal bar 10 (refer to FIGS. 3 and 23) from which depends the elongated rod 42. The projections 68 are received in corresponding recesses or apertures 69 formed on the horizontal bar 70 and are primarily designed to lock the first segment 48 on the elongated rod 42 against rotation. In other words, this arrangement causes the first segment 48 to pivot in the second segment 50 when the elongated rod 42 turns.

The first segment 48 is made of any suitable plastics material that resists abrasion and is also sufficiently solid to withstand the pressures applied on it during use. Nylon has been found to be suitable for this purpose.

Figure 16:
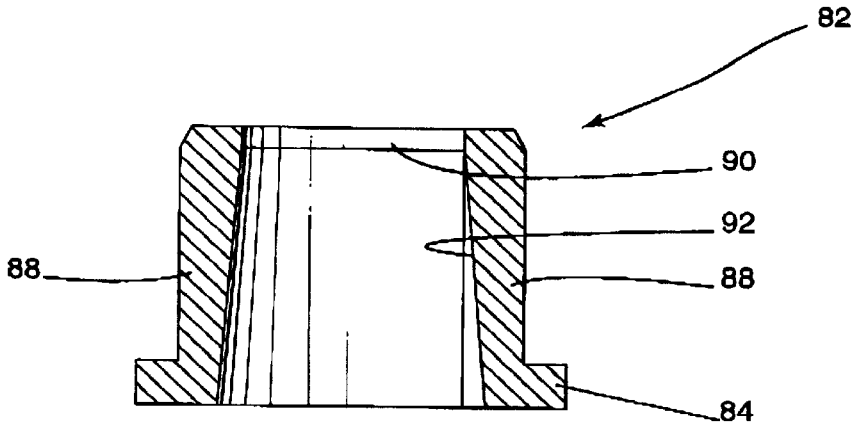
FIG. 16 is a cross sectional view of the second segment taken along lines 16—16 in FIG. 15.
Figure 17:
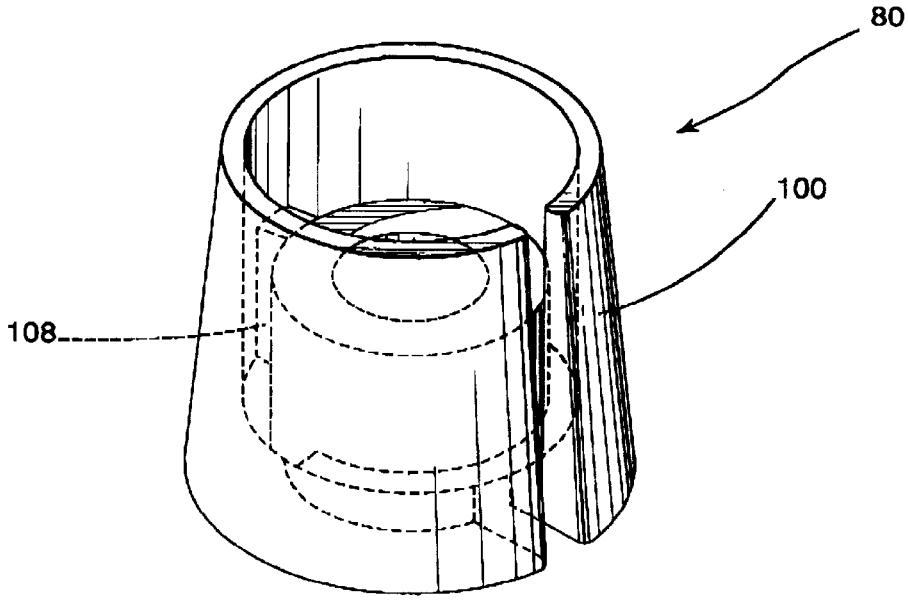
FIG. 17 is a perspective view of the first segment of the second bearing assembly of the pivot assembly in accordance with the invention.

Referring back to FIG. 3, the second bearing assembly 46 comprises a first segment 80 and a second segment 82 that are matingly received into one another. The structure of the second segment 82 is illustrated in greater detail in FIGS. 13, 14, 15, and 16. The structure of the second segment 82 is very similar to the structure of the second segment 50 with the exception that the body of the second segment 82 is slightly longer, while their external transverse dimensions are about the same. More particularly, the second segment 82 comprises a radially projecting flange 84 from which extends upwardly a cylindrical body 86. From the cylindrical body 86 project radially an array of regularly spaced ribs 88 whose purpose is to frictionally engage the inner wall at the lower end of the tubular element 36 to retain the second segment 82 in the tubular element 36. The cylindrical body 86 defines at its upper end a circular bore 90 designed to receive the elongated rod 42. Internally, as it will be apparent from FIG. 16 the second segment 82 defines an upwardly tapering recess 92.

Figure 18:
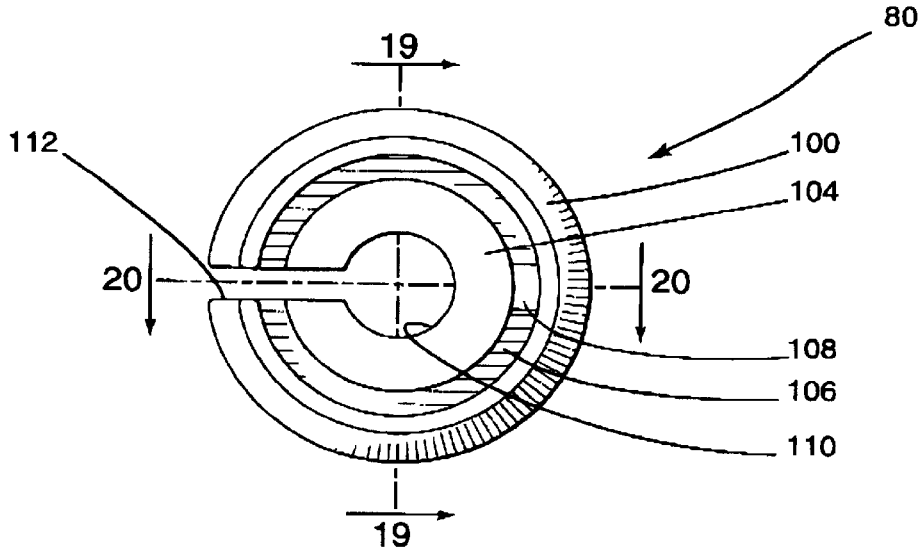
FIG. 18 is a top plan view of the first segment depicted in FIG. 17.
Figure 19:
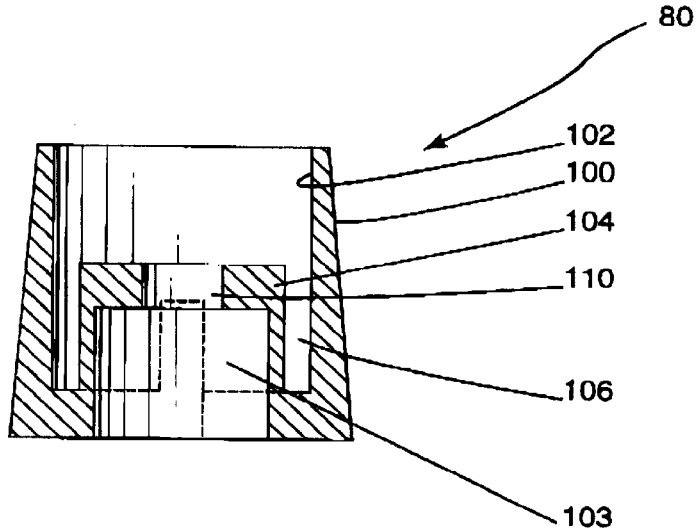
FIG. 19 is a cross sectional view taken along lines 19—19 in FIG. 18.
Figure 20:
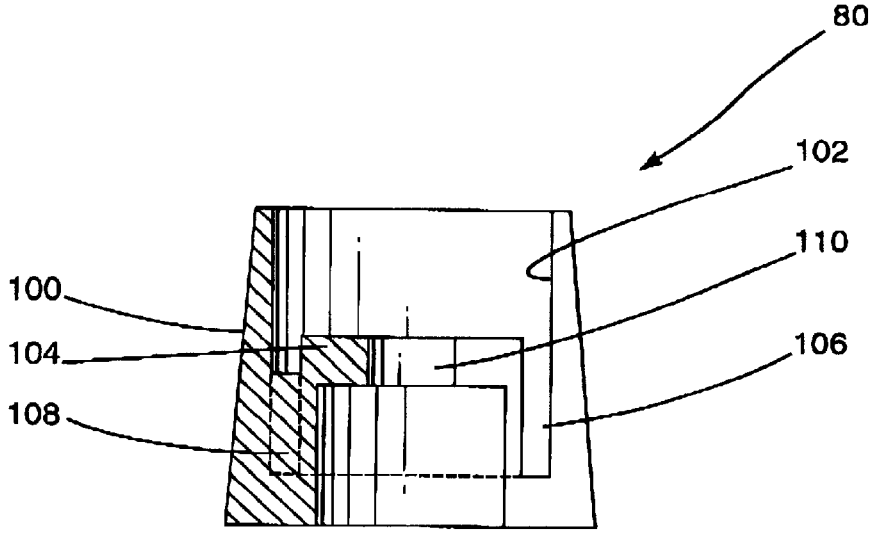
FIG. 20 is a cross sectional view taken along lines 20—20 in FIG. 18.

FIGS. 17, 18, 19 and 20 illustrate the structure of the first segment 80. Functionally speaking, the first segment 80 is similar to the first segment 48 described earlier in that it is capable of closing the aperture defined by the bearing assembly 46 around the elongated rod 42 in order to reduce or eliminate clearances. More particularly, the first segment 80 is in the shape of a truncated conical body comprising an outer tapering wall 100. Internally, as best shown at FIGS. 19 and 20, the first segment 80 includes a generally cylindrical void 102. At the base of this void is provided a generally cylindrical projection 104 that is of a lesser diameter than the diameter of the cylindrical void 102. This arrangement creates at the base of the void 102 an annular space 106 whose continuity is interrupted only by a key 108. The key 108, as shown at FIG. 18 approximates the shape of a rectangular body. The purpose of the key 108 as it will be described later in greater detail is to lock the first segment 80 on the elongated rod 42 such as to prevent the two components from pivoting one with respect to the other.

The cylindrical projection 104 defines a cavity 103 that includes a central bore 110 establishing a passageway between the cavity 103 and of the cylindrical void 102. The purpose of the cavity 103, as it will be described in greater detail later is to receive a coil spring to maintain the first and the second segment of the bearing assembly 46 pressed one against the other. The bore 110 is provided to receive a bolt for holding of the coil spring in place.

The first segment 80 also includes a slot 112 that extends along the elongated rod 42 creating a gap between the outer wall 100 and the internal bore 110. As in the case of the first segment 48, the slot 112 allows the first segment 80 to tighten the elongated rod when subjected to radial compression.

Figure 20A:
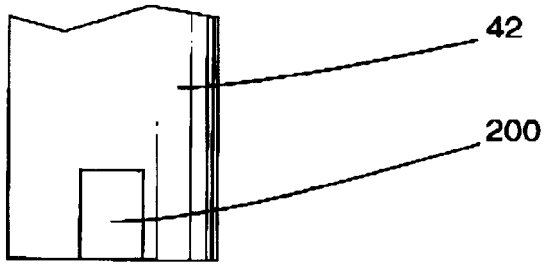
FIG. 20*a* is a fragmentary side elevational view of an elongated rod.
Figure 21:
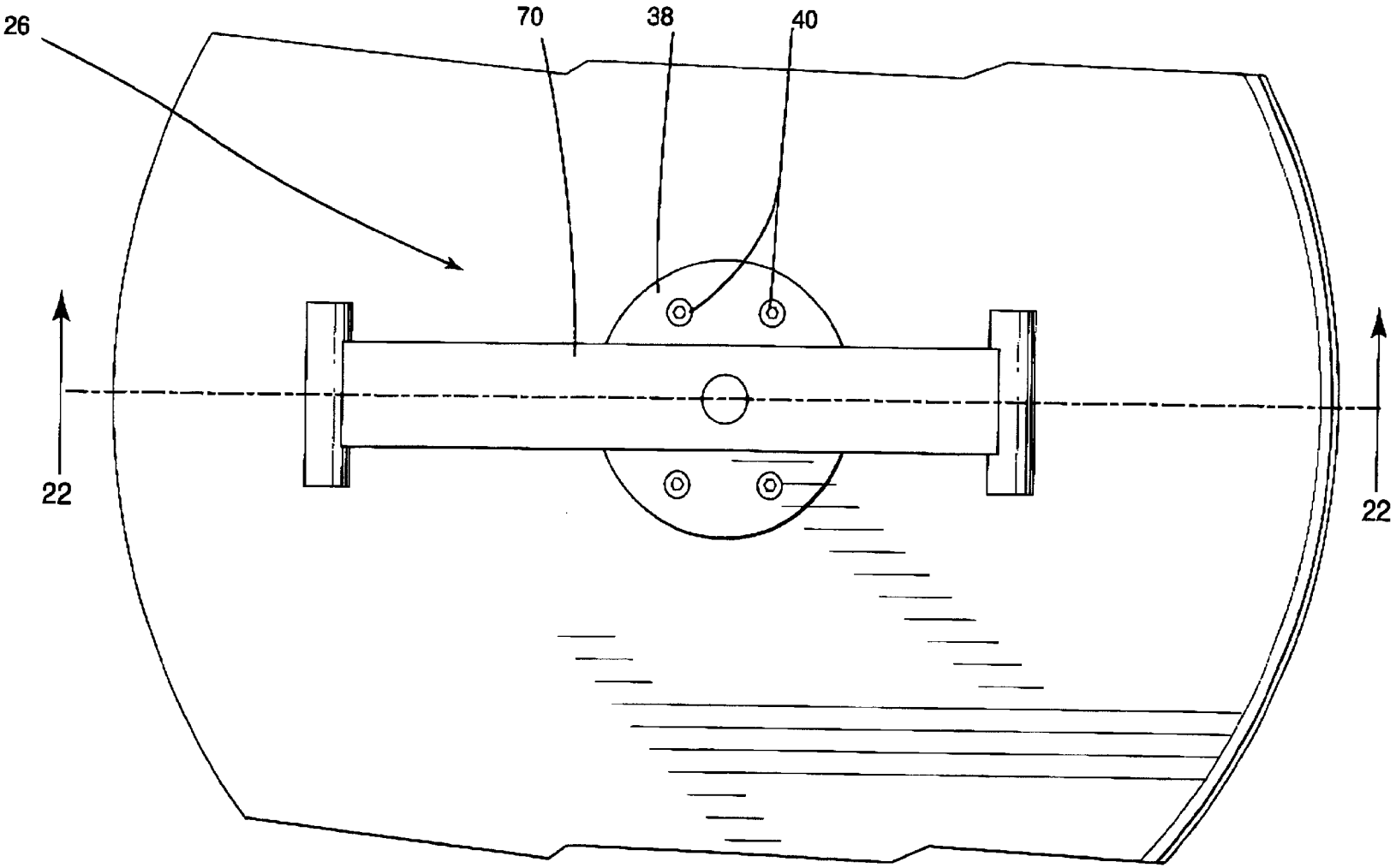
FIG. 21 is a top plan view of the pivot assembly in accordance with the invention.
Figure 22:
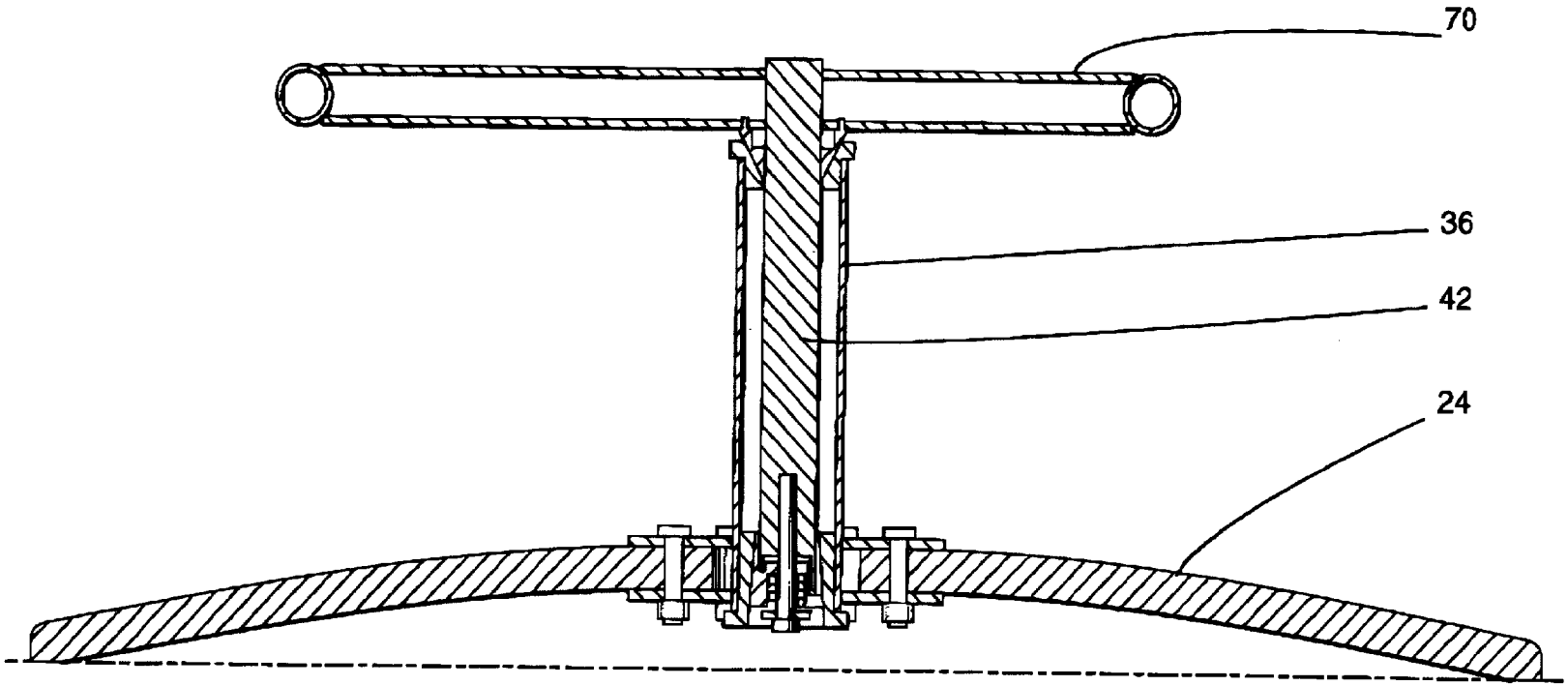
FIG. 22 is a cross sectional view taken along lines 21—21 in FIG. 21.

In use, the first segment 80 is received into the internal tapering recess 92 of the second segment 82. When these two components are assembled, the bore 90 and the bore defined by the cylindrical void 102 are in a condition of alignment such as to create an aperture through which the elongated rod 42 can pass. The elongated rod 42 receives the first segment 80 at its lower end. The elongated rod 42 is hollow and it fits the annular space 106. In addition, the lower end of the elongated rod 42 is provided with a notch 200 (shown in FIG. 20*a*) that is designed to accept the key 108. In this fashion, the first segment 80 is prevented from rotating on the elongated rod 42. Evidently, alternative ways of securing the first segment 80 on the elongated rod 42 can be considered without departing from the spirit of the invention.

Figure 23:
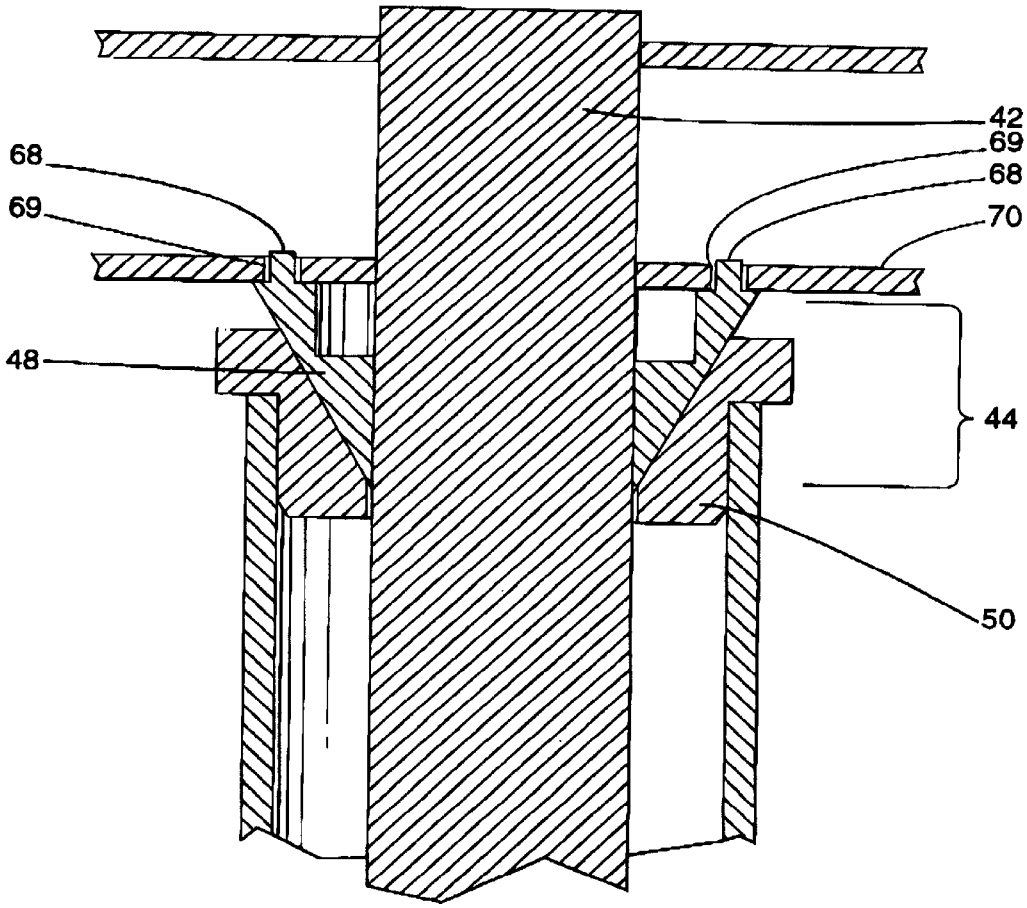
FIG. 23 is an enlarged view of a first bearing assembly of the pivot assembly shown in FIG. 22.
Figure 24:
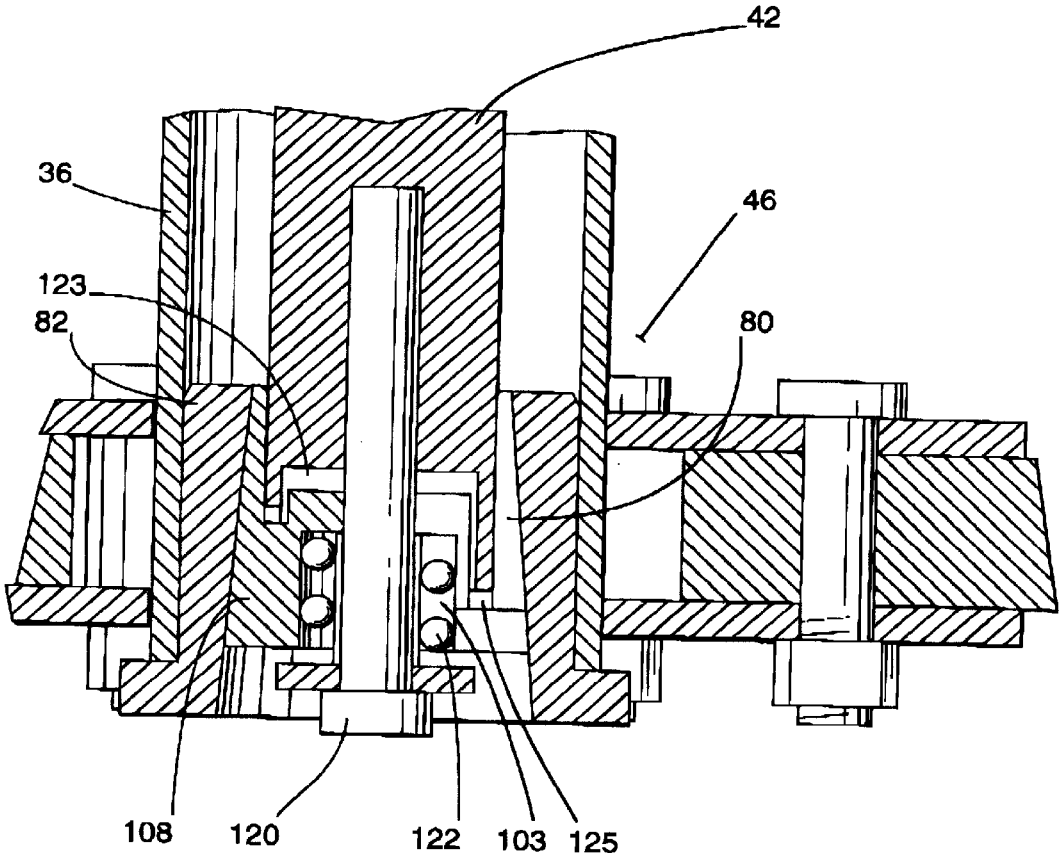
FIG. 24 is an enlarged view of a second bearing assembly of the pivot assembly shown in FIG. 22.

The structure of the pivot assembly 26 in the fully assembled condition is shown at FIGS. 21, 22, 23 and 24. Referring to FIG. 23, the first segment 48 of the bearing assembly 44 is received in the second segment 50. The elongated rod 42 extends through the aligned bores of the first and second segments 48, 50. FIG. 24 illustrates the bearing assembly 46 in greater detail. The elongated rod 42 is received into the first segment 80 that, in turn is received in the second segment 82. A mechanical fastener 120 such as a bolt is inserted through the bore 110 and its threaded shank is engaged in the elongated rod 42. A coil spring 122 is received in the cavity 103. The coil spring 122 is maintained in a compressed condition in the cavity 103 by the head of the bolt 120.

The relative dimensions between the elongated rod 42 and the first segment 80 are such as to create two gaps 123 and 125 that allow the first segment 80 to move axially on the elongated rod 42. This movement is done against the resiliency of the coil spring 122. This arrangement urges the segments of each bearing assembly 44, 46 toward one another. The consequence is to generate on the first segments 48, 80 a radial inwardly acting pressure by virtue of the tapering mating surfaces of the segments. As described earlier, such radial pressure causes the first segments 48, 80 to tend to close the apertures defined by the respective bearing assemblies, thus reducing or entirely eliminating clearances between the elongated rod 42 and the bearing assemblies 44, 46.

This clearance reduction mechanism is enhanced at the level of the first bearing assembly 44 when a person sits in the chair. The body weight creates additional downward pressure on the bearing assembly 44 that causes the first segment 48 to close even further on the elongated rod 42.

The downward pressure resulting from the weight of the occupant in the chair actually has the opposite effect on the bearing assembly 46 as it tends to unseat the first segment 80 from the second segment 82. This movement is very limited in practice since the bearing assembly 44 prevents the elongated rod 42 to move downwardly, however, to some extent the segments of the bearing assembly 46 tend to separate from one another. This effect is counterbalanced by the coil spring 122 compensating any downward movement of the first segment 80. Accordingly, the coil spring 122 acts to maintain a minimal amount of force on the first segment 80 against the second segment 82 that, in turn, produces at least some radial force on the first segment 80 tending to tighten it around the elongated rod 42.

Figure 25:
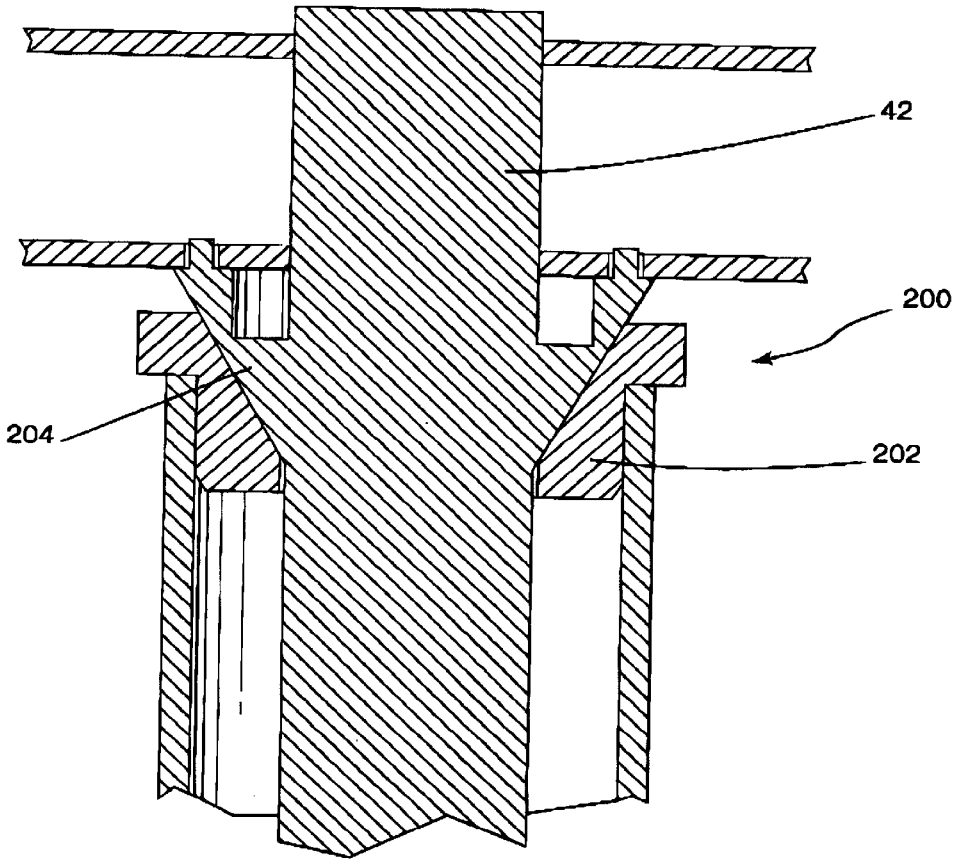
FIG. 25 is a side elevational view of the elongated rod of the pivot assembly according to a variant.

FIG. 25 illustrates a variant of the bearing assembly 44. This bearing assembly, designated by the reference numeral 200 comprises a second segment 202 that is identical to the segment 50. The bearing assembly 200 also comprises a first segment 204 that is formed integrally with the elongated rod 42. This form of construction allows to lock the first segment 204 on the elongated rod 42 against any possibility of relative movement both in the axial direction and in the transverse direction. In one possible form of implementation, the first segments 204 and the elongated rod 42 are machined from a single piece of material. Alternatively, the first segment 204 can be manufactured separately from the elongated rod 42 and later affixed to the elongated rod such as to prevent movement between the two components. Adhesives, welding or any suitable mechanical fasteners can be used for this purpose.

It is intended that the present application covers the modifications and variations of this invention provided that they come within the scope of the appended claims and their equivalents.

I claim:

1. A pivot assembly for swiveling chairs, said pivot assembly being suitable for supporting a body supporting structure of the chair on a chair base and for allowing the body supporting structure of the chair to swivel in relation to the chair base, said pivot assembly comprising:

a first pivot assembly component for connection to the body supporting structure of the chair;

a second pivot assembly component for connection to the chair base, one of said first and second pivot assembly components including an elongated rod oriented generally upright, the other of said first and second pivot assembly components including an elongated tubular element receiving said elongated rod;

a bearing assembly between said first and second pivot assembly components, said bearing assembly allowing said pivot assembly components to swivel one relative to the other, said bearing assembly defining an aperture for receiving said elongated rod, said bearing assembly including a first segment and a second segment, said first segment including a tapering projection, said second segment including a tapering recess matingly receiving said tapering projection, said bearing assembly being responsive to pressure urging said segments against one another to tend to close said aperture on said elongated rod.

2. A pivot assembly as defined in claim 1, wherein said elongated rod has a generally circular cross-sectional shape.

3. A pivot assembly as defined in claim 2, wherein said first and second segments include respective bores in a condition of alignment when said tapering projection is received into said tapering recess, said bores defining said aperture.

4. A pivot assembly as defined in claim 3, wherein the pressure urging said first and said second segments against one another causes said second segment to urge said first segment toward said elongated rod to tend to close said aperture on said elongated rod.

5. A pivot assembly as defined in claim 4, wherein said tapering projection tapers downwardly.

6. A pivot assembly as defined in claim 5, wherein said first segment includes a slot extending along said elongated rod, said slot allowing said first segment to tighten around said elongated rods and this tends to close said aperture on said elongated rod, in response to pressure urging said first and second segments against one another.

7. A pivot assembly as defined in claim 6, wherein said first segment is locked on said elongated rod against rotation about said elongated rod.

8. A pivot assembly as defined in claim 7, wherein said first and second segments am made of polymeric material.

9. A pivot assembly as defined in claim 1, comprising a resilient member urging the first and second segments of said bearing assembly toward one another.

10. A pivot assembly as defined in claim 9, wherein said bearing assembly is a first bearing assembly, said pivot assembly including a second bearing assembly, said second bearing assembly including an aperture receiving said elongated rod, said second bearing assembly being located in a spaced apart relationship relative to said first bearing assembly.

11. A pivot assembly as defined in claim 10, wherein said second bearing assembly includes a first segment and a second segment, the first segment of said second bearing assembly including a tapering projection, the second segment of said second bearing assembly including a tapering recess matingly receiving the tapering projection of the first segment of said second bearing assembly.

12. A pivot assembly as defined in claim 11, wherein the first and second segments of said second bearing assembly include respective bores in a condition of alignment, the bores of the first and second segments of said second bearing assembly defining the aperture of said second bearing.

13. A pivot assembly as defined in claim 12, wherein the tapering projection of said first segment of said second bearing assembly tapers upwardly.

14. A pivot assembly as defined in claim 13, wherein the first segment of said second bearing assembly includes a slot extending along said elongated rod and allowing the first segment of said second bearing assembly to tighten around said elongated rod in response to pressure applied on said second bearing assembly and urging the first and the second segments of said second bearing assembly toward one another.

15. A pivot assembly as defined in claim 14, wherein said first segment of said second bearing assembly is locked on said elongated rod against rotation about said elongated rod.

16. A pivot assembly as defined in claim 15, wherein said resilient member is a first resilient member, said pivot assembly further including a second resilient member operative to urge the first and second segments of said second bearing assembly toward one another.

17. A swiveling chair comprising the pivot assembly of claim 1.

18. A swiveling and rocking chair comprising the pivot assembly of claim 1.

19. The use of a pivot assembly for manufacturing swiveling chairs, said pivot assembly being suitable for supporting a body supporting structure of a chair on a chair base and allowing the body supporting structure of the chair to swivel freely with relation to the chair base when the chair is occupied, said pivot assembly comprising:

a first pivot assembly component for connection to the body supporting structure of the chair;

a second pivot assembly component for connection to the chair base, one of said first and second pivot assembly components including an elongated rod oriented generally upright the other of said first and second pivot assembly components including an elongated tubular element receiving said elongated rod;

a bearing assembly between said first and second pivot assembly components, said bearing assembly allowing said pivot assembly components to swivel one relative to the other, said bearing assembly including a first segment and a second segment, said first segment including a tapered projection and being concentrically mounted on said elongated rod, said first segment being secured on said elongated rod against movement on said elongated rod along a direction parallel to said elongated rod and a direction transverse to said elongated rod, said second segment including a tapered recess matingly receiving said tapered projection and a bore receiving said elongated rod, said bearing assembly being responsive to pressure urging said segments against one another to tend to close said aperture on said elongated rod.

* * * * *

UNITED STATES PATENT AND TRADEMARK OFFICE

CERTIFICATE OF CORRECTION

PATENT NO. : 6,619,742 B1
DATED : September 16, 2003
INVENTOR(S) : Pierre Bellefleur It is certified that error appears in the above-identified patent and that said Letters Patent is hereby corrected as shown below:

Column 9,
Line 23, replace “am” with -- are --

Column 10,
Line 30, after “upright” insert -- , --

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,619,742 B1
DATED : September 16, 2003
INVENTOR(S) : Pierre Bellefleur It is certified that error appears in the above-identified patent and that said Letters Patent is hereby corrected as shown below:

Column 9,
Line 23, replace “am” with -- are --

Column 10
Line 30, after “upright”, insert -- , --

Signed and Sealed this

Third Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,619,742 B1
DATED : September 16, 2003
INVENTOR(S) : Pierre Bellefleur It is certified that error appears in the above-identified patent and that said Letters Patent is hereby corrected as shown below:

Column 2,
Line 63, before "implementation" insert -- Continuing with the same non-limiting example of --

Signed and Sealed this

Second Day of November, 2004

JON W. DUDAS
*Director of the United States Patent and Trademark Office*